US005154321A

United States Patent [19]

Shomer

[11] Patent Number: 5,154,321

[45] Date of Patent: Oct. 13, 1992

[54] DISPENSING CONTAINER FOR MULTI-COMPONENT CURABLE COMPOSITIONS

[76] Inventor: John Shomer, 19 Hareuth St., Hod-Hasharon, Israel

[21] Appl. No.: 641,290

[22] Filed: Jan. 15, 1991

[51] Int. Cl.[5] ..... B67B 5/60

[52] U.S. Cl. ..... 222/145; 222/80; 222/146.5; 222/189; 222/383; 222/386; 222/459; 222/564; 206/219; 525/939; 239/135; 239/398; 366/146; 366/336; 366/349

[58] Field of Search ..... 222/80, 189, 145, 459, 222/146.2, 146.3, 146.5, 372, 383, 386, 564; 206/219; 525/939; 366/146, 336, 341, 349; 239/135, 398, 399, 432

[56] References Cited

U.S. PATENT DOCUMENTS

| | | | |
|---|---|---|---|
| 3,119,528 | 1/1964 | Dunning, Jr. | 222/80 |
| 3,159,312 | 12/1964 | Van Sciver, II | 222/145 X |
| 3,339,802 | 9/1967 | Weiner et al. | 222/80 X |
| 3,491,916 | 1/1970 | Graham | 222/80 |
| 3,651,990 | 3/1972 | Cernei | 222/145 X |
| 3,684,136 | 8/1972 | Baumann | 206/219 X |
| 3,718,235 | 2/1973 | Cronan | 222/145 |
| 3,739,947 | 6/1973 | Baumann et al. | 206/219 X |
| 3,966,643 | 6/1976 | Morane et al. | 206/219 X |
| 4,121,772 | 10/1978 | Cronan | 222/145 X |
| 4,201,316 | 5/1980 | Klingaman | 222/80 |
| 4,735,509 | 4/1988 | Rausch | 222/145 X |
| 4,801,008 | 1/1989 | Rich | 206/219 |
| 4,808,006 | 2/1989 | Kaufeler | 206/219 X |
| 4,858,759 | 8/1989 | Mauthe et al. | 206/219 X |
| 4,893,730 | 1/1990 | Bolduc | 222/80 |
| 4,936,511 | 6/1990 | Johnson et al. | 222/145 X |

FOREIGN PATENT DOCUMENTS

| | | | |
|---|---|---|---|
| 65804 | 11/1955 | France | 206/219 |
| 2182522 | 11/1973 | France | 206/219 |
| 8005863 | 5/1982 | Netherlands | 206/219 |
| 1405330 | 9/1975 | United Kingdom | 206/219 |

*Primary Examiner*—Robert P. Olszewski
*Assistant Examiner*—Boris Milef
*Attorney, Agent, or Firm*—Herbert Dubno

[57] ABSTRACT

The invention consists of a system for storing, initiating curing of and dispensing a multicomponent curable material. One of the component materials is in the form of a multiplicity of discrete units surrounded by respective destructible layers of a substance which is nonreactive with the components. The system includes a device for rupturing the destructible layers while the components are being dispensed. This device may include a screen, roller pair, or heating element.

10 Claims, 10 Drawing Sheets

DISPENSING CONTAINER FOR MULTI-COMPONENT CURABLE COMPOSITIONS

FIELD OF THE INVENTION

The present invention relates, in general, to multi-component coating, sealing, casting and gluing materials which may be hardened by the mixing of reactive components thereof and, in particular, to a system for storing, mixing and dispensing such materials.

BACKGROUND OF THE INVENTION

Multi-component coating, sealing casting and gluing materials which are cured by the mixing of reactive components thereof are well known and, in many cases, are superior to their one component equivalents. An example of a two component material is an 'epoxy' adhesive, having base and hardener components. When these two components are mixed together, they react to form a high quality adhesive that may be superior in quality to an alternative one-component adhesive that hardens by drying and curing in the air. It will be appreciated that many other types of multi-component materials are also known.

A disadvantage of conventionally available multi-component materials is that each reactive component thereof is supplied in its own packaging, and that a user is thus required to mix each of the two reactive components according to predetermined proportions, as specified by the manufacturer. As a result, ready-to-use one component materials are often used in preference to superior multi-component alternatives, as it is far more convenient and quicker to use such materials supplied in a dispenser, such as a tube having a nozzle, than to mix two or more separately supplied components that are required to be mixed in predetermined proportions and thereafter placed in a dispenser prior to use.

On a larger, industrial scale, spraying and dispensing equipment for multi-component curable materials is known. Such equipment is, however, generally expensive and complex and, particularly on a small scale, is inconvenient to use.

OBJECT OF THE INVENTION

The present invention seeks to provide a system for storing all the components of a multi-component material, such as an adhesive or a sealant, in a single container, and for mixing the components within and dispensing the resulting mixture from the container, thereby overcoming disadvantages of known art.

There is provided, therefore, in accordance with an embodiment of the invention, a system for storing, initiating curing of and dispensing a multi-component curable material having two or more components which interreact chemically when mixed together, the system including a single container for storing the interreactive components; outlet means, associated with the container and through which the multi-component curable material may be dispensed; means for preventing chemically reactive contact between each of the components; and means for permitting chemically reactive contact between the components so as to initiate curing thereof prior to dispensing thereof through the outlet means.

Additionally in accordance with an embodiment of the invention, the container defines an internal space in which the interreactive components are dispersed, and the means for preventing contact includes means for enclosing discrete portions of at least one of the components so as to chemically separate that component from the other components, and the means for permitting contact includes means for causing release of the enclosed discrete portions prior to the dispensing thereof through the outlet means, so as to permit chemically reactive contact to occur between the components.

The present invention moreover provides a curable composition which comprises at least two interreactive components and which is capable of self-cure when said at least two components react together. At least one of the interreactive components is in discrete form in which substantially each discrete unit thereof is surrounded by a disintegratable layer of material, which material under normal conditions of storage does not react with any one of the interreactive components. The disintegratable layer of material (which may be, but need not be, composed of two or more sub-layers of different materials) is subject to disintegration by, for example, fracture by application of mechanical stress thereto, or melting by application of heat thereto. It is to be understood that there is no restriction on the nature of the components other than that they are capable of self-cure when mixed together, that is to say, no further ingredient is necessary for cure to be effected. Thus in general, the components may be selected as appropriate from curable monomers, oligomers, and polymers, and from initiators, promoters, accelerators and catalysts.

The curable composition may comprise also a solvent medium for at least one of the interreactive components, provided that the solvent medium does not dissolve a significant amount of the layer under normal conditions of storage.

Persons skilled in the art will be aware that the curable compositions may contain optional nonreactive components such as fillers, colorants plasticizers.

BRIEF DESCRIPTION OF THE DRAWING

The present invention will be more fully understood and appreciated from the following detailed description, taken in conjunction with the accompanying drawing, in which.

DETAILED DESCRIPTION OF THE INVENTION

Figure 1:
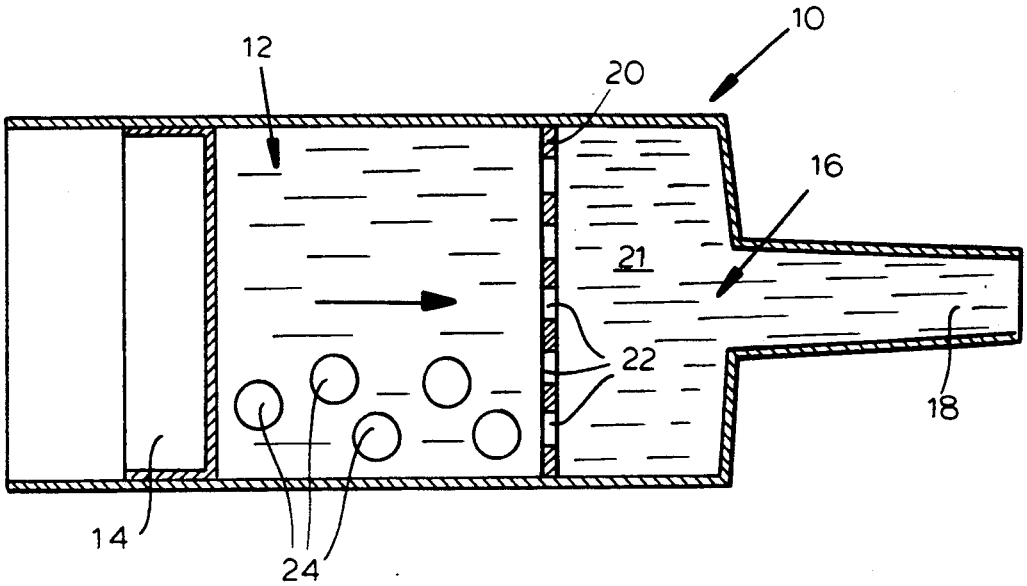
FIG. 1 is a schematic cut-away side view of a dispensing container for a multi-component curable material, constructed and operative in accordance with an embodiment of the invention.

Reference is now made to FIG. 1, in which is shown a dispensing container 10, for generally any sort of multi-component curable coating, sealing, casting, potting and gluing materials which are cured by mixing two or more reactive components thereof. As described above in the 'Background of the Invention' although multi-component materials are superior to their one component equivalents, the one component materials are conventionally much easier to use, as no on-site mixing is necessary.

The present invention seeks, to provide, therefore, a system for storing, mixing and dispensing a multi-component curable material from a single container. According to the invention, two or more inter-reactive components of a multi-component curable material can be stored together inside the container in nonreactive contact, and the material can, when desired, be mixed inside the container and dispensed therefrom.

Container 10 which, typically, although not necessarily, is a disposable container, defines an interior storage space 12. In the present embodiment, the reactive components of, typically, a two-component curable material are stored in the space 12 in a nonreactive dispersion. This is facilitated by isolating one of the reactive components in discrete form, e.g. in powder, granular, globule, pellet or capsule form in a surrounding layer of a neutral material, i.e. a material that is nonreactive with either of the reactive components. Examples of different materials are given hereinbelow. The other of the reactive components, in this particular embodiment, remains as a liquid medium in which the globules are suspended.

In other embodiments of the invention, however, both or all reactive components may be provided in discrete form.

As shown in FIG. 1, a two component dispersion of globules suspended in a liquid medium, as described above, is contained within a storage space 12. Storage space 12 is bounded at one end by a movable plunger 14, or the like, and at the other end 16, by an outlet nozzle 18. A screen element 20 is provided transversely across the storage space, i.e. across the direction of flow of the material when it is dispensed, and defines apertures 22 that, while permitting flow of the reactive component in liquid form, are sufficiently small so as to confine the relatively large globules or capsules 24, to a space between the screen element and the plunger 14. Generally, the globules may have a diameter of between 0.5 mm and 10 mm, although more preferably of about 2 to 3 mm.

Figure 2:
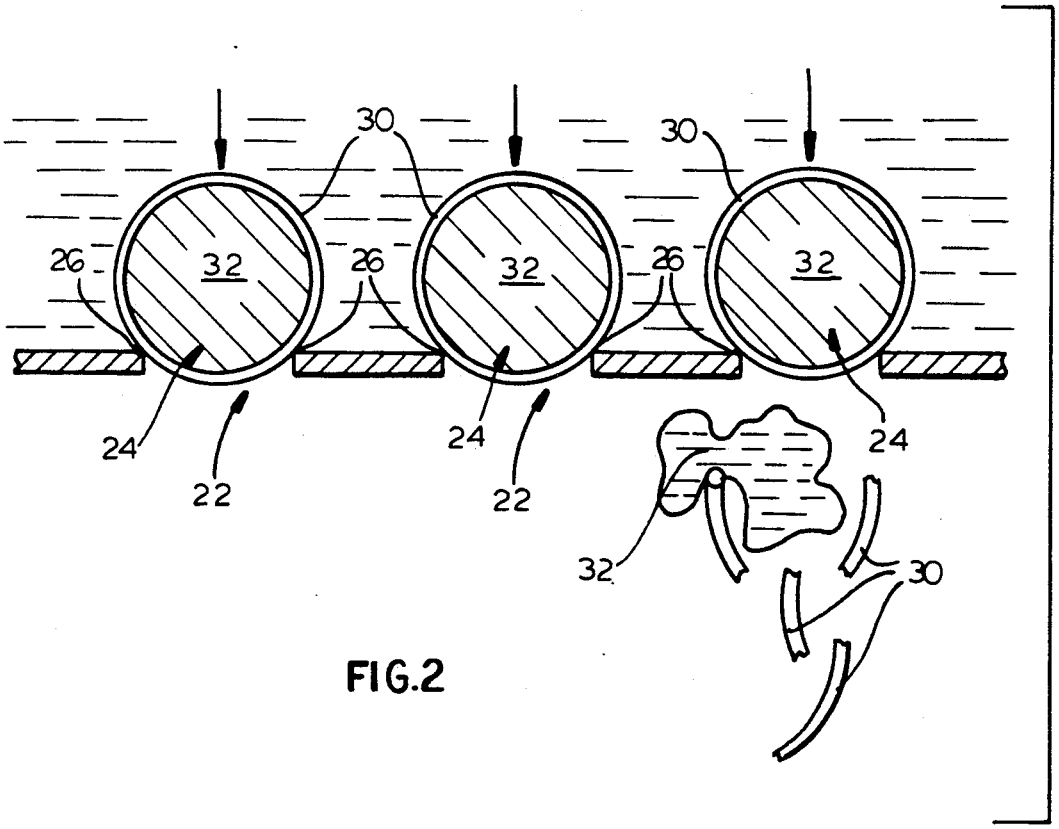
FIG. 2 is an enlarged cut away view of the screen element shown in FIG. 1, and illustrating mixing of two reactive components of the curable material downstream of the screen element.

Referring now also to FIG. 2, when plunger 14 (FIG. 1) is displaced towards the outlet nozzle end of the container, as shown, the curable material inside the container is pressed in the same general direction. In response to this pressurization, the liquid component is able to pass through screen element 20 to a mixing chamber 21 defined between the screen element and the outlet nozzle. The globules or capsules 24 are initially prevented from moving into the mixing chamber by the screen element, as the apertures of the screen element are smaller than the globules.

When, however, the applied pressure reaches a predetermined minimum pressure, the neutral layers 30 encasing the globules 24 engaged by the screen element are broken by being pressed against edges 26 of the solid, relatively rigid portions 28 of the screen element so as to release the hitherto confined mass of reactive component 32 into the other, non-confined component. The now released component 32 is carried downstream of the screen element into the mixing chamber, in which it mixes with the other reactive component so as to initiate the reactive curing or hardening of the curable material as it is extruded or dispensed through outlet nozzle 18.

It will thus be appreciated by persons skilled in the art that, while preventing chemically reactive contact between the reactive components of a multi-component curable material prior to mixing, the present invention also provides a dispensing container that is operative to initiate curing of the material in response to pressure applied thereto by displacement of the plunger, which displacement is operative to pass the reactive components through the built-in screen, thereby causing the reactive components to become mixed immediately before the multi-component material is dispensed. A further advantage of the present invention is that it makes obsolete the use of expensive and complex multi-component spraying equipment, as known in the art.

Figure 13:
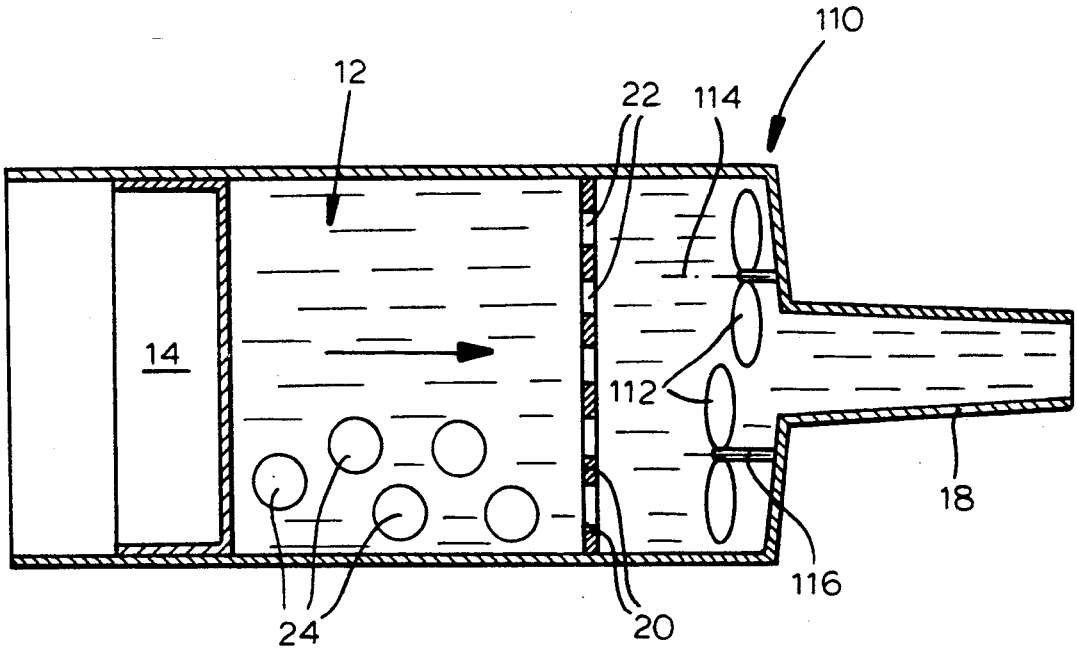
FIG. 13 is a diagrammatic section which shows a dispensing container similar to that of FIG. 1, but also including mechanical agitating apparatus according to a further embodiment of the invention.

Referring briefly to FIG. 13, a dispensing container 110 is shown. Container 110 is similar to container 10, as shown and described above in conjunction with FIG. 1, but also includes apparatus 112 for mechanically agitating the partially mixed material downstream of screen 20. Although apparatus 112 is shown, in the present example, to be a pair of overlapping impellers, which typically are rotated about respective axes 114 and 116 by the flow of the curable material, apparatus 112 may alternatively be any other suitable apparatus known in the art.

It will also be appreciated that agitating apparatus 112 is shown in conjunction with a single screen solely by way of example, and agitating apparatus may alternatively be provided in conjunction with any of the other embodiments of the present invention.

Figure 3:
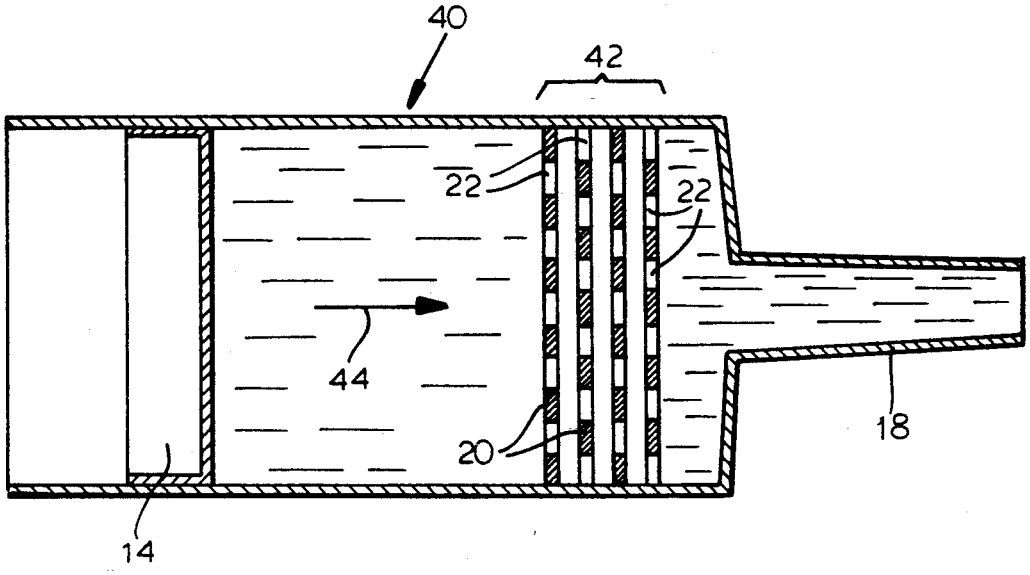
FIG. 3 is a schematic cut-away side view of a dispensing container for a multi-component curable material, constructed and operative in accordance with an alternative embodiment of the invention.
Figure 4:
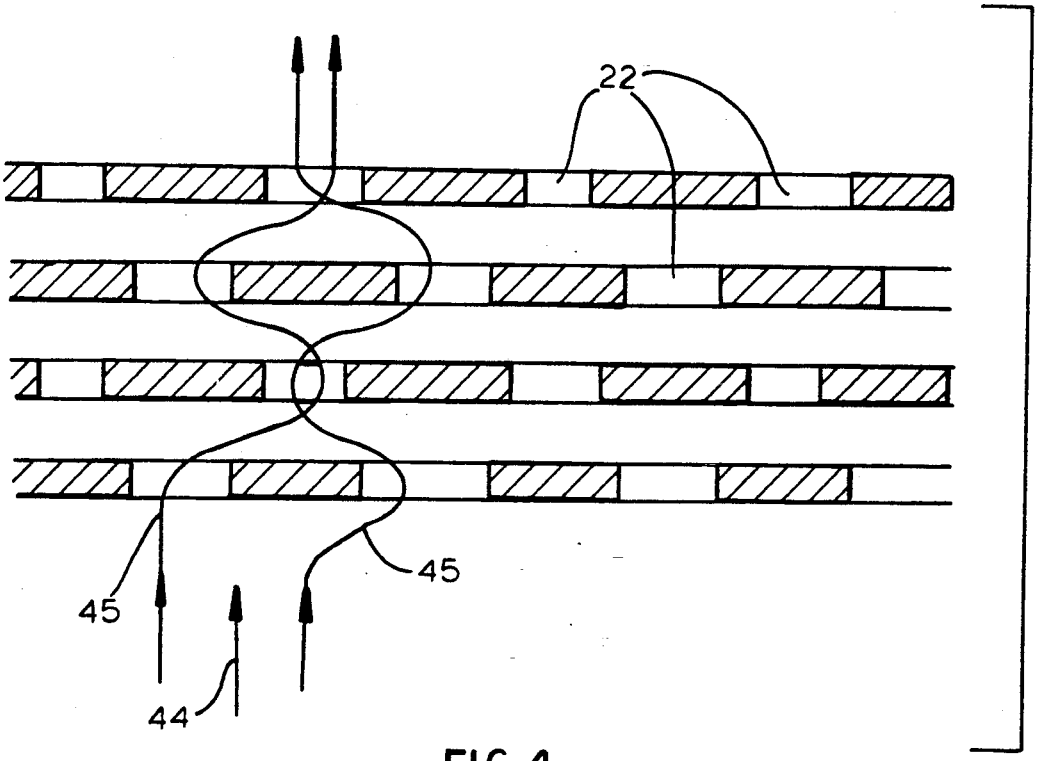
FIG. 4 is an enlarged cut away view of a multiple screen arrangement as shown in FIG. 3, and illustrating mixing of two reactive components of the curable material downstream of the screen arrangement.

Reference is now made briefly to FIG. 3, in which is shown a dispensing container 40. Container 40 is generally similar to container 10 as shown and described above, and similar components are denoted, therefore, by similar reference numerals. However, whereas container 10 includes only a single screen element 20, container 40 includes a multiple screen arrangement 42, comprising a plurality of screen elements 20. As shown, the screen elements are arranged such that their apertures are not aligned along straight lines. As shown in FIG. 4, this non-alignment forces the reactive components to flow along generally sinusoidal paths 45 and greatly increases, therefore, the mixing experienced by the components as they pass through the multiple screen arrangement.

Figure 5:
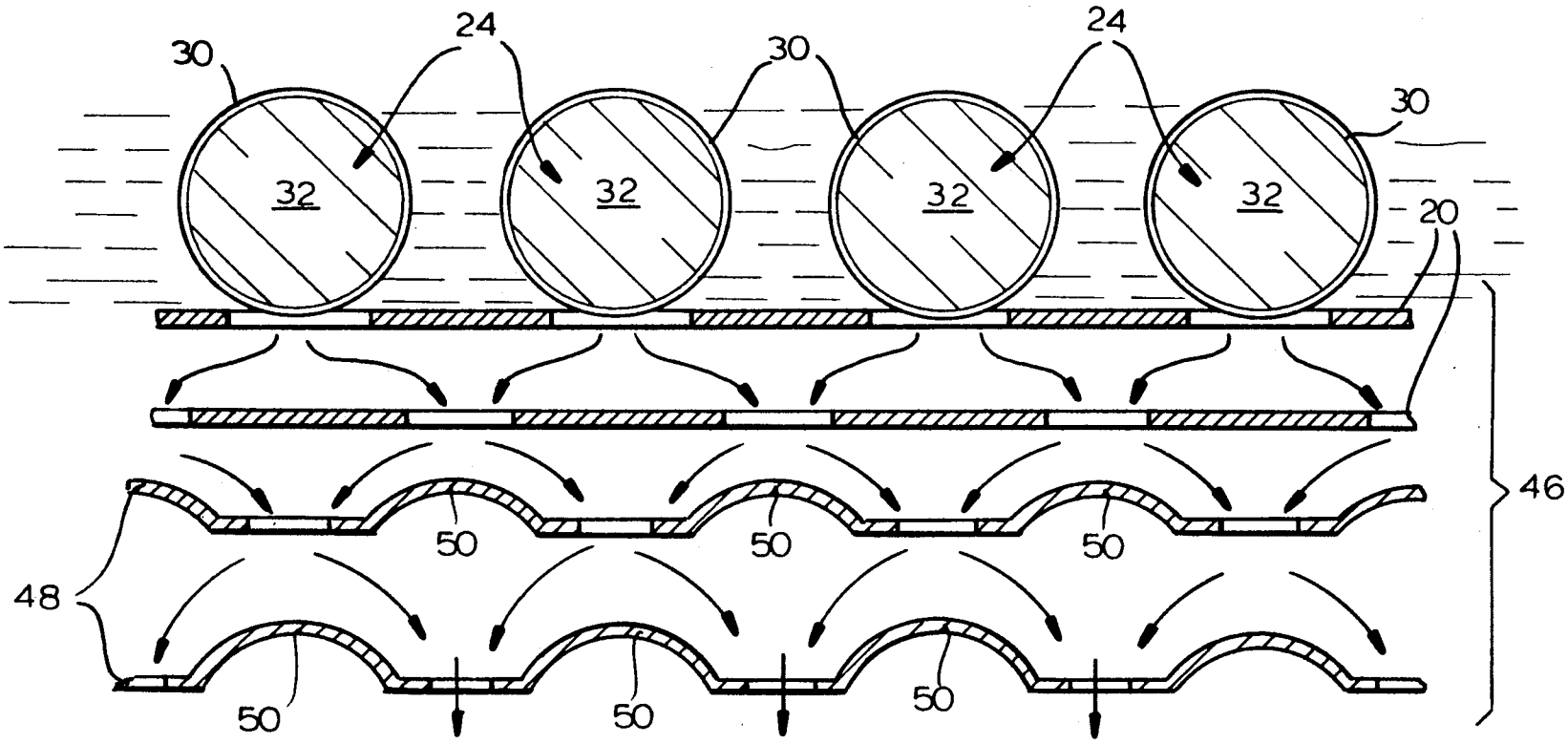
FIG. 5 shows an alternative configuration of the multiple screen assembly depicted in FIG. 4.

Reference is now made to FIG. 5, in which is shown a multiple screen arrangement 46 that is generally similar to the screen assembly 42 shown in FIG. 4, except that the screen assembly 46 includes, in addition to a number of generally planar screen elements 20, a number of non-planar screen elements 48 having generally convex protrusions 50, which enhance the mixing of the components of the curable material as they flow therepast.

Figure 14:
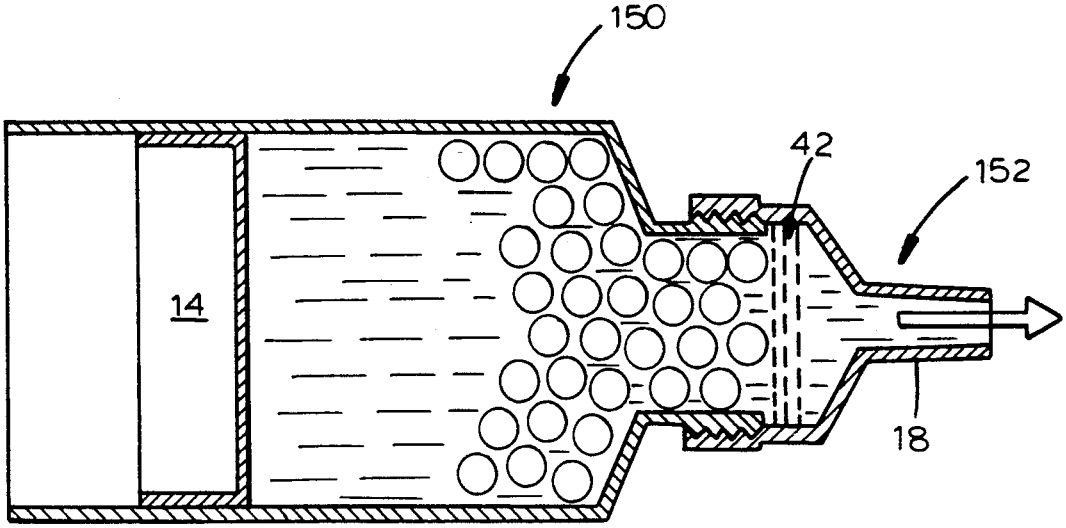
FIG. 14 is a similar view which shows a dispensing container constructed according to a further embodiment of the invention.

Referring now briefly to FIG. 14, there is shown a dispensing container 150 with a removable outlet unit 152. Container 150 is generally similar to container 40 (FIG. 3) as described above, and similar components are denoted, therefore, by similar reference numerals. However, whereas container 40 may not be reusable after it has been used once, due to residual cured material located in the generally integrally formed nozzle portion clogging the nozzle portion, as the removable outlet unit 152 of the present embodiment includes both screen arrangement 42 and the nozzle 18, a clogged nozzle unit may simply be removed and replaced by a new outlet unit prior to reuse.

Figure 6:
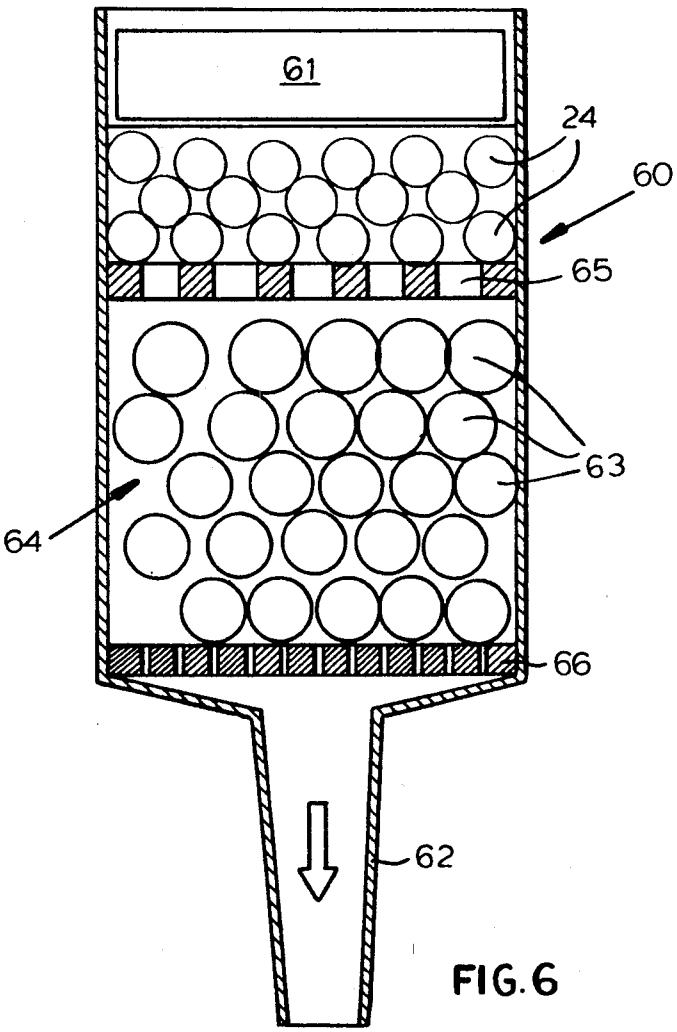
FIG. 6 is a schematic cut-away side view of a dispensing container for a multi-component curable material, constructed and operative in accordance with an additional embodiment of the invention.

Reference is now made to FIG. 6, in which there is shown a dispensing container 60, containing a two component dispersion of globules 24 suspended in a liquid medium, as described above in conjunction with FIGS. 1–5. The container has a movable plunger 61 at one end, and an outlet nozzle 62 at the other end. A plurality of mixing elements 63, such as polyethylene spheres, are retained in a mixing chamber 64 defined between respective rear and front screen elements 65 and 66. The mixing elements are operative to provide thorough mixing of the reactive components.

As plunger 61 is displaced towards the outlet nozzle end of the container 60, as with previous embodiments of the invention, the curable material inside the container is pressurized in the same general direction. In response to this pressurization, the liquid component is able to pass through rear screen element 65 into mixing chamber 64. The globules or capsules 24 are initially prevented from moving into the mixing chamber by the rear screen element, as the apertures of the screen element are smaller than the globules.

When, however, the applied pressure reaches a predetermined minimum pressure, the respective neutral layers 30 (FIGS. 2) of those globules 24 engaged by the rear screen element are broken by being pressed thereagainst so as to release the hitherto confined mass of reactive component 32 into the other, non-confined component. The now released component 32 is carried downstream of the rear screen element into the mixing chamber. As both the reactive components flow along generally sinusoidal flow paths, between mixing elements 63, the components become thoroughly mixed together as they pass through the mixing chamber so as to initiate the reactive curing or hardening of the curable material as it is extruded or dispensed through outlet nozzle 62.

Figure 7:
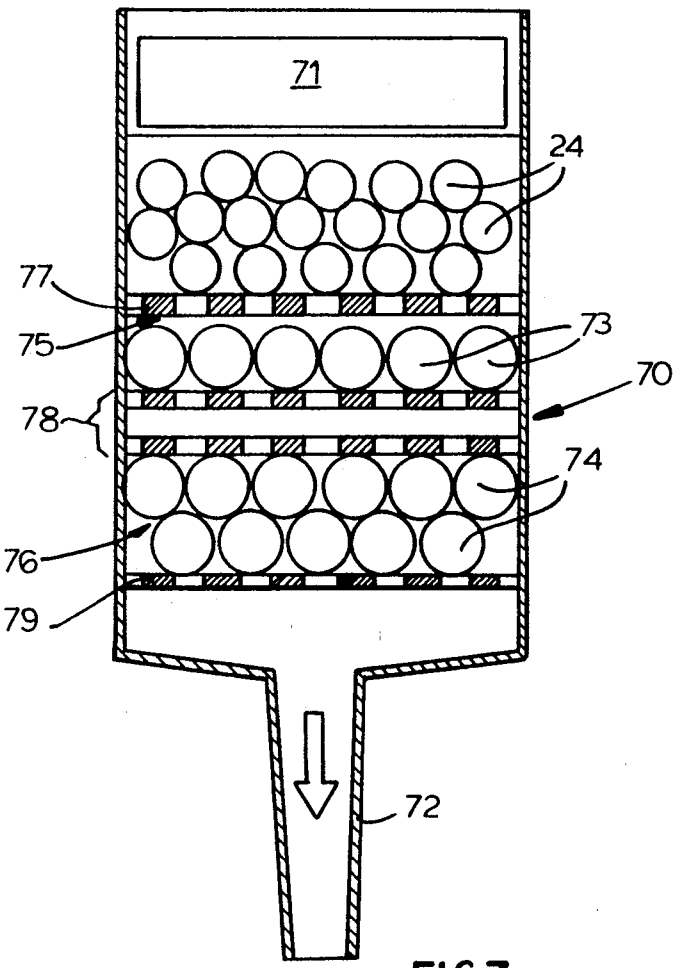
FIG. 7 is a schematic cut-away side view of a dispensing container for a multi-component curable material, constructed and operative in accordance with yet a further embodiment of the invention.

Reference is now made to FIG. 7, in which there is shown a further dispensing container 70, containing a two component dispersion of globules 24 suspended in a liquid medium, as described above in conjunction with FIG. 1–6. The container has a movable plunger 71 at one end, and an outlet nozzle 72 at the other end. Respective first and second pluralities of mixing elements 73 and 74, for example, such as polyethylene spheres, are retained in respective first and second mixing chambers 75 and 76, defined between respective rear, intermediate and front screen elements 77, 78 and 79. The mixing elements are operative to provide thorough mixing of the reactive components.

As plunger 71 is displaced towards the outlet nozzle end of the container 70, as with previous embodiments of the invention, the curable material inside the container is pressurized in the same general direction. In response to this pressurization, the liquid component is able to pass through rear screen element 77 into first mixing chamber 75. The globules or capsules 24 are initially prevented from moving into the mixing chamber by the rear screen element, as the apertures of the screen element are smaller than the globules.

When, however, the applied pressure reaches a predetermined minimum pressure, the respective neutral layers 30 (FIG. 2) of those globules 24 engaged by the rear screen element 77 are broken by being pressed thereagainst so as to release the hitherto confined mass of reactive component 32 into the other, non-confined component. The now released component 32 is carried downstream of the rear screen element 77 into the first mixing chamber 75, and through intermediate screen element 78 into second mixing chamber 76. As both the reactive components flow along generally sinusoidal flow paths, through the various mixing elements, the components become thoroughly mixed together as they pass through the mixing chambers so as to initiate the reactive curing or hardening of the curable material as it is extruded or dispensed through outlet nozzle 72.

Figure 8A:
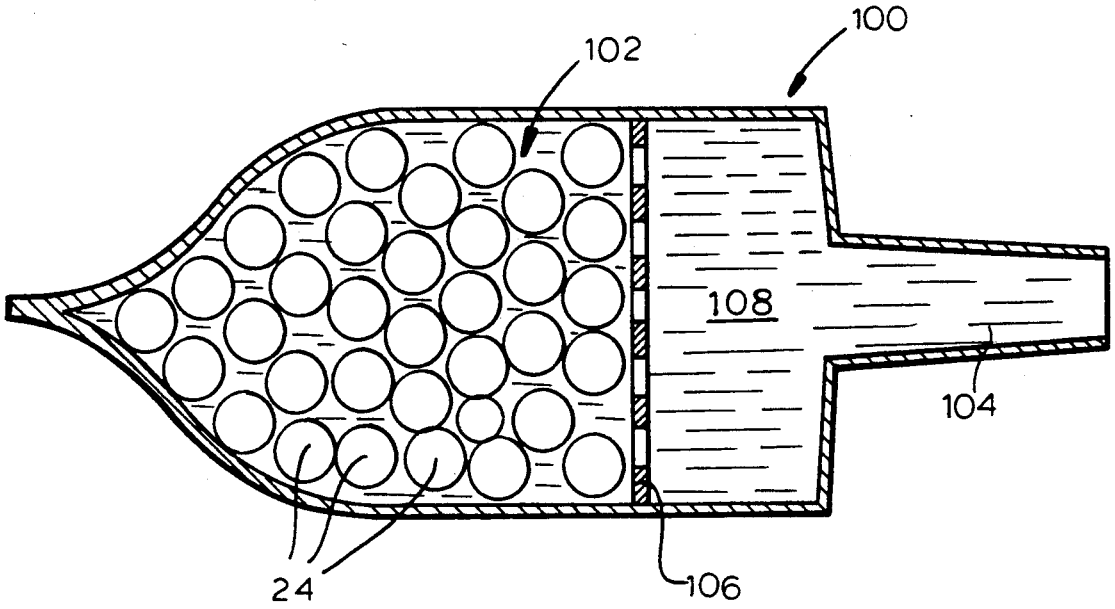
FIGS. 8A and 8B show in diagrammatic section a crushable dispensing container for a multicomponent curable material constructed and operative in accordance with an embodiment of the invention.
Figure 8B:
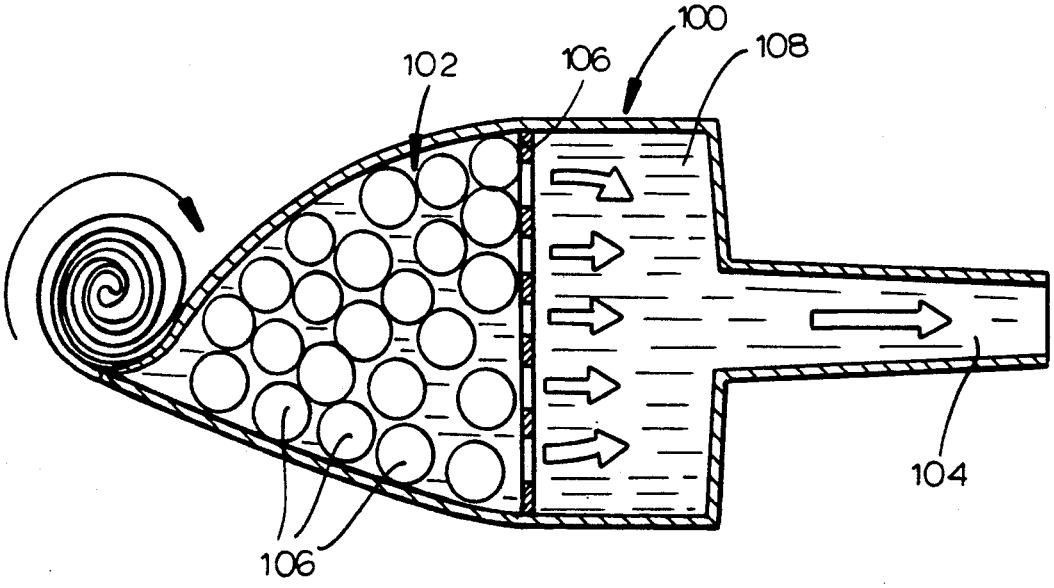

Reference is now made briefly to FIGS. 8A and 8B, in which there is shown a dispensing container 100 which, although generally similar to container 10 of FIGS. 1, is a tubelike container, such as is conventionally used, inter alia, for premixed adhesives. Container 100 defines an internal space 102, an outlet nozzle 104 and a screen element 106. A mixing chamber 108 is defined between screen element 106 and outlet nozzle 104. A dispersed mass of a two component curable material is provided within the container in predetermined porportions. Mixing and dispensing of the curable material is achieved by crushing the container, such as by rolling up its closed end, as shown in FIG. 10B. As the container is crushed, the material is forced through the screen element, causing the contents of the globules to be mixed in mixing chamber 108 with the unconfined component and the material is thereafter extruded though nozzle 104 in initial stages of curing.

Figure 9A:
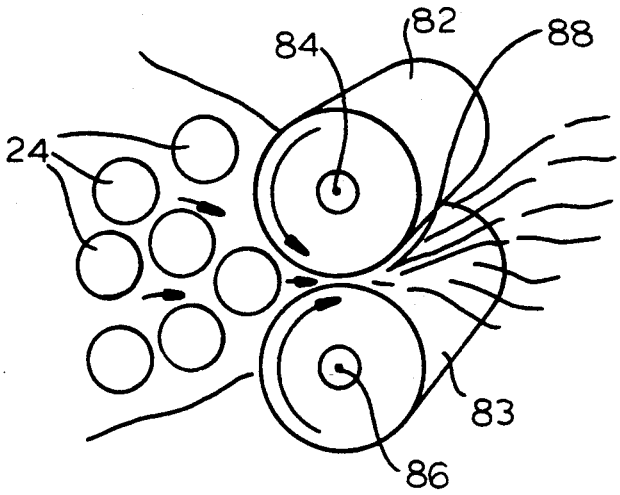
FIGS. 9A and 9B are a diagrammatic perspective view and side view which show a dispensing container employing a pair of rollers to provide mixing of reactive components of a multi-component curable material.
Figure 9B:
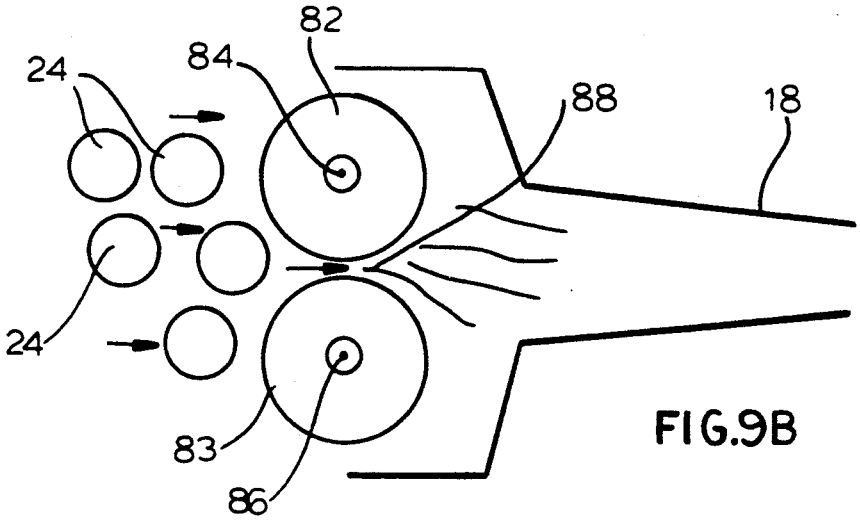

Reference is now made briefly to FIGS. 9A and 9B, in which there are shown a pair of rollers 82 and 83, which, according to the present embodiment, are mounted in place of or in addition to the various screen arrangements shown and described hereinabove. Rollers 82 and 83 are mounted for rotation about respective parallel axes 84 and 86, so as to define a narrow gap 88. This gap is analogous to the apertures of the above-described screen elements and is small relative to the globules in which reactive component 32 is contained.

As the curable material dispersion is urged towards outlet nozzle 18, as described above in conjunction with the embodiments of FIGS. 1 and 2, the pressure applied to the rollers 82 and 83 causes them to be rotated, such that globules engaged thereby are crushed, thereby breaking the respective neutral layer of each globule so as to release the reactive component contained thereby into reactive contact with the other reactive component. The dispersion, now in initial stages of curing, is passed through the gap 88 between the rollers and is finally dispensed through outlet nozzle 18.

Figure 10:
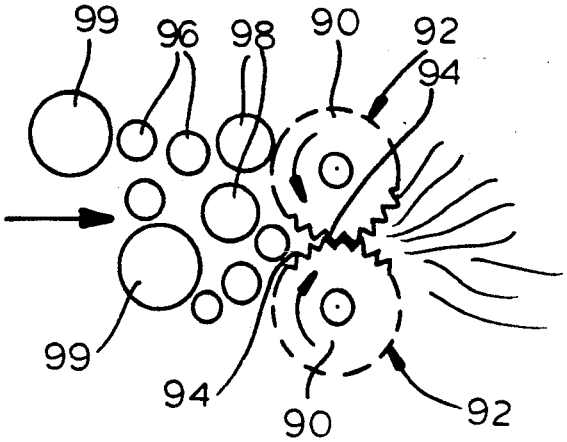
FIG. 10 is a diagrammatic side view which shows an embodiment similar to that of FIGS. 9A and 9B, but wherein the rollers also define generally radially extending surface protrusions.

Reference is now made to FIG. 10, in which are illustrated a pair of rollers 90, in an arrangement generally similar to that shown in FIGS. 9A and 9B. Rollers 90, however, define on their exterior surfaces 92, generally radially extending ridges 94, appearing as teeth-like projections in side view, which provide not only improved engagement of the globules as they are urged towards the rollers, but also ensure more efficient crushing or breaking open of the globules.

In the present embodiment, all the reactive components are in globular form, a first component being shown by small globules 96, a second component being shown by intermediate globules 98 and a third component being shown by large globules 99. Provision of each of the reactive components in the form of globules with generally solid outer layers provides for convenient handling of the material, and the provision of rollers with ridges or teeth is particularly suitable for ensuring that each globule is broken open efficiently when engaged by the rollers.

Figure 15:
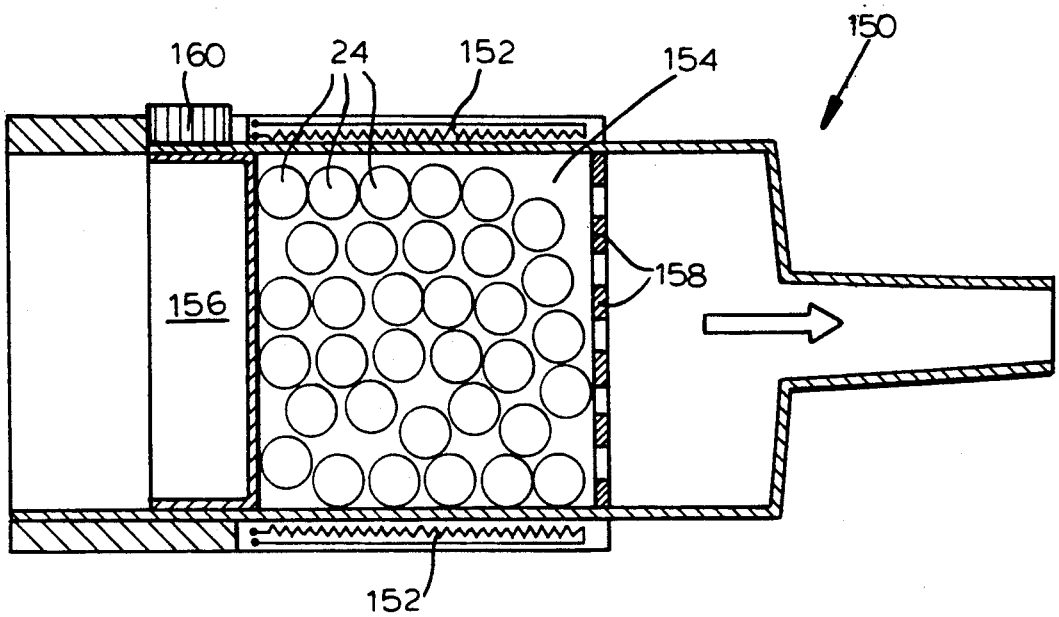
FIG. 15 is a schematic cut-away side view of a dispensing container for a multi-component curable material, constructed and operative in accordance with a further embodiment of the invention.

Reference is now made to FIG. 15, in which there is shown a dispensing container, 150, constructed and operative in accordance with an alternative embodiment of the present invention. The general configuration of container 150 is similar to that of container 10 as shown and described above in conjunction with FIG. 1.

In this embodiment, however, there are provided, typically, a pair of heating elements 152, for melting the coating 34 (FIG. 2) of the globules 24, thereby permitting the above-described mixing of the hitherto separated reactive components. The heating elements 152 are thus arranged adjacent to an internal space 154 in which the reactive components are contained, and which is defined between a plunger 156 and a screen element 158. It will be appreciated that in the present embodiment, the screen element 158 aids in mixing of the reactive components once the mixing has been initiated. The heating elements may be any suitable, typically electrical heating elements, and may be activated by depressing a switch 160 provided on the container. An appropriate battery power source (not shown) is also provided.

It will also be appreciated that any appropriate number of screen elements, and any type of mixing elements, typically as shown and described above in conjunction with any of the preceding drawings, may be provided in conjunction with the present embodiment of the invention.

In the present embodiment, and also in those described hereinbelow in conjunction with FIG. 16–19, wherein the reactive component contained in globular form is released from the globules by melting, rather than fracturing or crushing the coating 34 of the globules, although any meltable, nonreactive substance, as known in the art, may be used, an example of a coating is as follows:

the coating may comprise two layers, applied as described in Examples I–III below, and including an inner layer of a chemical insulation material, such as a low density polyethylene (LDPE) e.g. of 20 microns thickness, and an outer layer, providing mechanical protection to the globules, of chlorinated paraffin (70% chlorine), of e.g. 80–200 microns thickness. The described multiple layer melts at a temperature of 100°–150° C.

Figure 11:
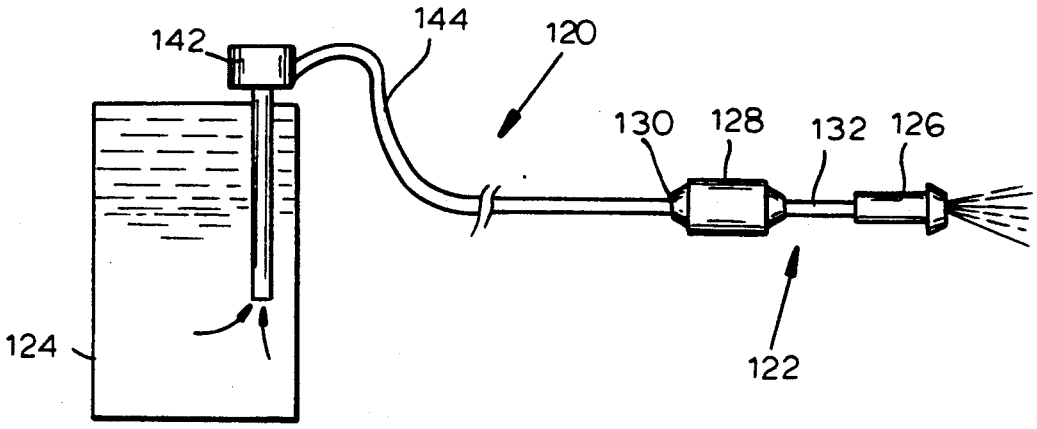
FIG. 11 is a diagrammatic elevational view which shows a split storage, mixing and dispensing system for multi-component curable materials, constructed in accordance with the present invention.

Reference is now made to FIG. 11, in which there is shown a split storage, mixing and dispensing system for multi-component curable materials, constructed in accordance with the present invention. The split system, referenced generally 120, is similar in principle to the previous embodiments of the present invention, except that whereas the previous embodiments refer to self-contained dispensing containers, the present system is characterized particularly by having a mixing and dispensing head, referenced generally 122, at a location remote from a storage container 124.

As will be appreciated by persons skilled in the art, whereas the dispensing containers described hereinabove may be particularly useful on a small scale, the present split system is suited particularly to large scale, continuous operations.

As shown, therefore, split system 120 has a refillable storage container 124, which may be used for storing a multi-component curable material as described above, for example, a two component material as described in conjunction with the embodiment of FIG. 1, wherein one reactive component is globularized and is dispersed in the other reactive component.

Figure 12:
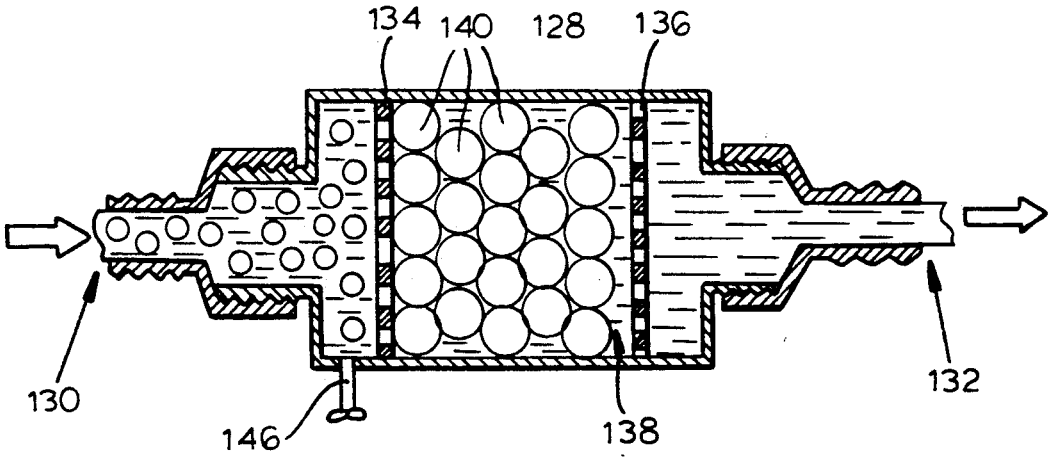
FIG. 12 is an enlarged cut-away view of the mixing unit shown in FIG. 11.

The mixing and dispensing head 122 has a spray head 126, from which the curing material is dispensed. Referring now also to FIG. 12, just upstream of the spray head is a mixing unit 128, defining an inlet 130 and an outlet or conduit means 132 which communicates with the spray head 126. The mixing unit 128 has respective upstream and downstream screen elements 134 and 136, between which is defined a mixing chamber 138, housing a plurality of mixing spheres 140, similar to those employed in the respective dispensing containers 60 and 70 of FIG. 6 and 7. It will be appreciated that in place of the shown structure, any other suitable structure, such as shown and described in conjunction with any of FIGS. 1–10 and FIGS. 13, may be used.

In operation, a pump 142, which may be any suitable pump known to one skilled in the art, may be used for pumping the neutral two-component dispersion along a conduit or line 144, which is typically a flexible hose, towards mixing and dispensing head 122. The curable material is pumped into mixing unit 128 via its inlet 130, and through upstream screen element 134.

Globules 24 suspended in the dispersion are punctured by engagement with the upstream screen element and their contents are thus released for mixing and chemical reaction with the other reactive component. The multi-component material, in its initial stages of curing, subsequently flows through outlet 132 so as to be dispensed via the spray head 126. An exemplary use of split system 120 is in the application of coatings.

As shown, a flush connection, shown at 146, (FIG. 12) may also be provided, so as to permit cleaning of the mixing chamber 138 and spray head 126 by use of an appropriate solvent.

Exemplary multi-component curable materials that may be usefully employed with the present invention may have as base materials, inter alia, expoxides, polyurethanes, polyesters, acrylics, polysulfides, and silicones, all of which cure after initial contact with appropriate reactants and/or catalysts.

Figure 16:
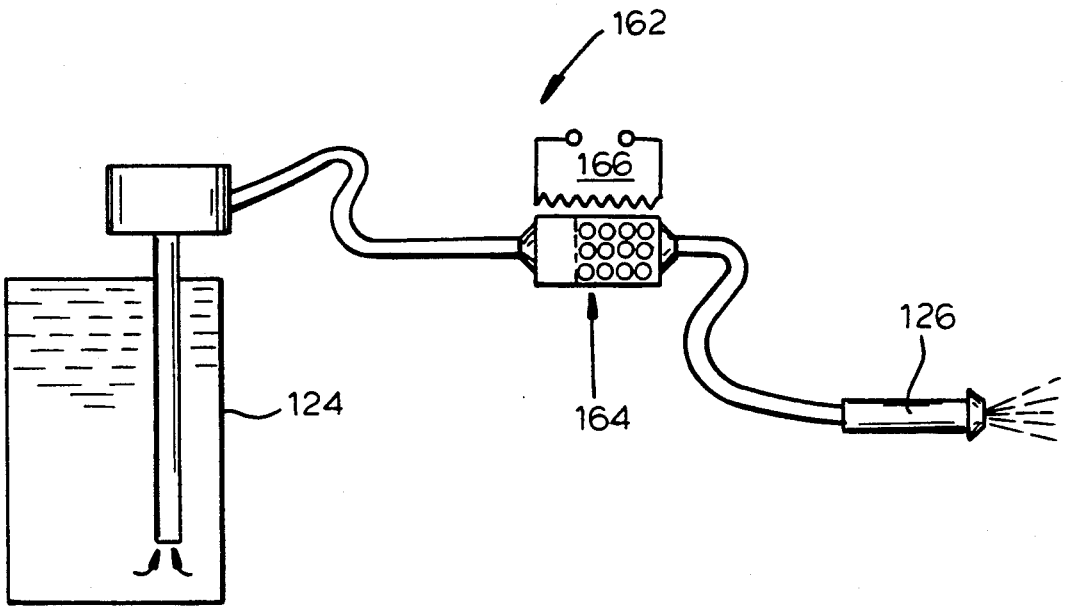
FIG. 16 in diagrammatic elevation shows a split storage, mixing and dispensing system for multi-component curable materials, constructed in accordance with yet a further embodiment of the present invention.

Reference is now made to FIG. 16, in which there is shown a split storage, mixing and dispensing system for multi-component curable materials, constructed in accordance with yet a further alternative embodiment of the present invention. The split system, referenced generally 162, is generally similar to system 120 shown and described above in conjunction with FIG. 11, but whereas the mixing unit 128 of the above-described system 120 is operative to cause fracture of coating 34 of the globules 24 so as to release their contents, the mixing unit 164 of the present embodiment operates on the principle of melting the coating 34, as described above in conjunction with the embodiment of FIG. 15. The remainder of the system 162 is substantially the same as system 120, and is, therefore, not described hereinbelow in detail.

Shown schematically at 166, therefore, is apparatus for heating and thus melting coating 34 (FIG. 2) of the globules.

Figure 17:
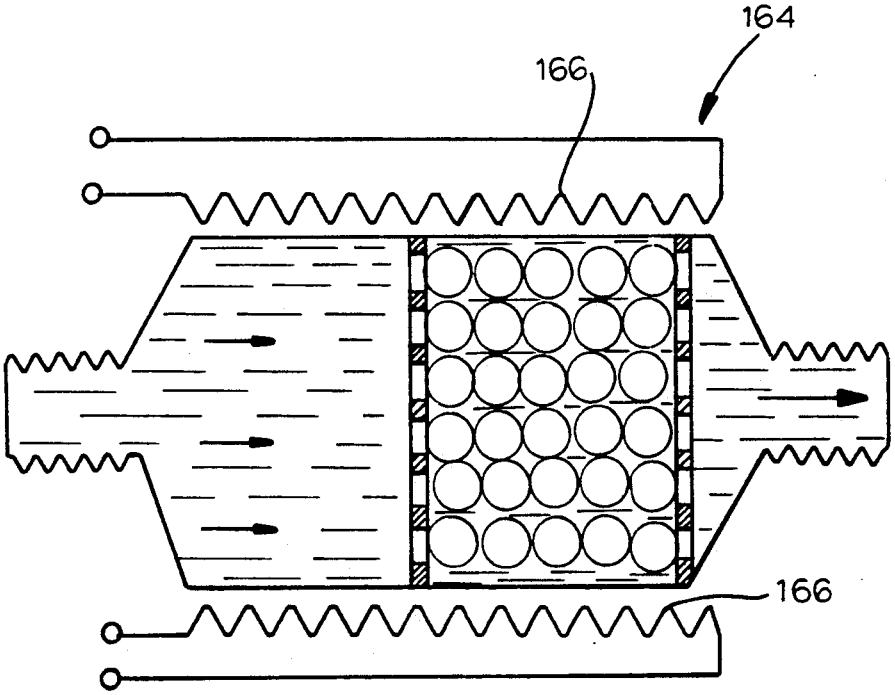
FIG. 17 is an enlarged detail view of the mixing unit employed in the system of FIG. 16.

Referring now to FIG. 17, the heating apparatus 166 is shown to be a pair of electrical heating elements, as shown and described above in conjunction with FIG. 15.

Figure 18:
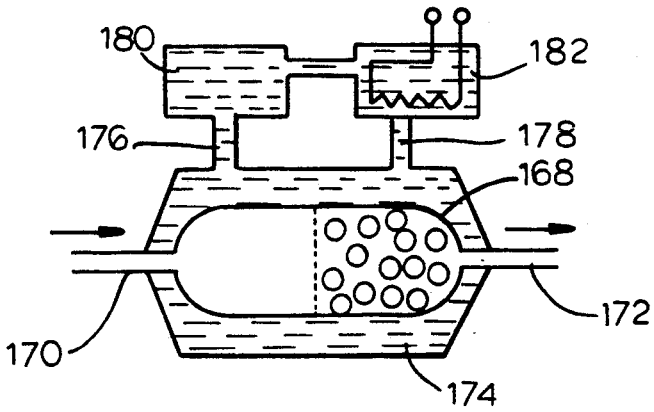
FIG. 18 in diagrammatic section shows a mixing unit that may be employed in the system of FIG. 16, in place of the mixing unit detailed in FIG. 17.

Referring now to FIG. 18, mixing unit 164 is shown to be an indirect heating system. The mixing unit includes an inner housing 168 having an inlet and an outlet, respectively referenced 170 and 172. The inner housing 168 is surrounded by an outer housing 174 communicating, via respective first and second fluid conduits, 176 and 178, with a fluid pump 180 and a heating unit 182. The heating unit, the outer housing and the conduits contain an appropriate fluid medium, for example, glycerine, which is heated, typically to a temperature of 100°–150° C. and driven, via an appropriate conduit, into thermal contact with the reactive components of the multi-component curable coating of the present invention, thereby to melt the coating of the globules and thus release their contents into chemically reactive contact with the other components or components.

Detailed examples of multi-component materials useful in the present invention are as follows:

EXAMPLE I

An adduct composition of
41.5% trimethylhexamethylenediamine,
37% benzyl alcohol,
5% salicylic acid, and
16.5% of epoxy resin (Equiv. Wt 190)

is gradually cooled to −17° C. Before complete solidification, 3 mm globules or pellets of the adduct are formed by any known method, for example, as per the formation of tablets by tablet compressing machines that are widely used in the pharmaceutical industry. The globules are placed in a coating pan and agitated, while melted paraffin wax is sprayed on until they are completely coated by the wax.

1000 grams of epoxy resin (Equiv. Wt 190) and 300 grams of titanium dioxide are passed on a three roll mill and mixed with 580 grams of the coated globules of the above adduct. The mixture is placed into the interior space of a dispensing container (FIGS. 1–10 and FIG. 13) or storage container (FIG. 11) of the invention.

The mixture is then pressed through 2.2–2.5 mm apertures of a screen element of the container, passing into a mixing chamber thereof filled with polyethylene spheres(*) wherein the adduct of the globules mixes with the carrying epoxy resin mixture so as to initiate curing of the sealant. This mixture is thus ready for direct application to a work piece, or it may subsequently be fed to a spray nozzle(**).

(*) e.g. in the embodiments of FIGS. 6 and 7.
() e.g. in the split system of FIG. 12**.

EXAMPLE II

Polysulfide Sealant 500 grams of manganese dioxide, 490 grams of chlorinated paraffin (40% chlorine) and 10 grams of sulfur powder are thoroughly mixed and then passed three times on a three roll mill.

The mixture is cooled to solidification and formed into spheres of about 3 mm in diameter. The cold, solid spheres are placed in a coating pan and exposed to a spray of melted synthetic wax until completely coated.

A mixture consisting of 1000 grams of polysulfide polymer LP32, 500 grams of precipitated $CaCO_3$, 300 grams of Santicizer 261 (manufactured by Monsanto Chemical Co., U.S.A.) and 50 grams of Aerosil 200, is mixed with 150 grams of the coated manganese dioxide spheres and placed in a container of the invention. Application of pressure causes the curable mixture to be passed through screen apparatus, rollers or the like and, thereafter, through an outlet, as a sealant in its initial stages of curing.

EXAMPLE III

Polyurethane Joint Sealant 1000 grams of 3,3-dimethyl-4,4-diaminodicyclohexyl methane is mixed with 100 grams of Levepox K10 (accelerator) and the mixture is cooled to below its solidification point and formed into 3 mm diameter globules. As described above, the globules are coated with wax.

1000 grams of urethane polymer Desmophen 11 and 80 grams of Aerosil are mixed together and 65 grams of the prepared globules are dispersed in the mixture.

The dispersion is then placed in a container of the invention and activated in a manner similar to that used to activate the polysulfide sealant (EXAMPLE II).

In general, multi-component materials used by divers may also be produced by encapsulating two or more components of the materials and by mixing the capsules of each component in desired proportions. The capsules can be mixed dry or, alternatively, suspended in a liquid medium which may either be any one of the other components or a neutral liquid or paste. The capsules are crushed as per any of the embodiments above, by rollers or screens, so as to release the contents of the capsules. Contact of the released capsule contents with the liquid medium is operative to initiate curing of the multi-component curable material. A plurality of plastic, glass, ceramic or metal spheres may also be present in the mixing chamber so as to permit their dispersion in the multi-component material, and the material may then be dispensed for immediate use.

It will be appreciated by persons skilled in the art that the present invention is not limited to what has been specifically shown and described hereinabove. The scope and spirit of the invention are rather to be understood by reference to the claims which follow.

I claim:

1. A system for storing, initiating curing of and dispensing a multicomponent curable material having at least two components capable of interacting upon being mixed together, said system comprising:

container means for storing both of said components;

outlet means on said container means for discharging a curable material formed upon mixing of said components;

means defining an internal space within said container means within which said components are mixed to form said mixture upstream of said outlet means, one of said components being present in said container means in a form of globules surrounded by respective destructible layers of a substance which is nonreactive with said components and which layers are in contact with the other of said component;

means for applying pressure to said components to cause said components to flow toward said outlet means; and a succession of at least three screen elements in said container means encountered by said components as said components pass under pressure through said space to said outlet means for intercepting said globules and effecting rupture of said layers at at least a minimum of said pressure to enable said globules to mix with said other component in said space and form the mixture passing to said outlet means, said screen elements being arranged so that apertures of one screen elements are offset from apertures of an adjacent screen element with respect to a linear path of said components and said mixture through said screen elements, thereby causing a nonlinear flow of said curable material through said screen elements.

2. The system defined in claim 1 wherein at least one of said screen elements is configured to impart a generally sinusoidal flow characteristic to portions of the flow of said curable material.

3. The system defined in claim 1 wherein said outlet means comprises spray head means for spraying said curable material and is connected with said space by conduit means defining a flow path for said material.

4. A system for storing, initiating curing of and dispensing a multicomponent curable material having at least two components capable of interreacting upon being mixed together, said system comprising:

container means for storing both of said components;

outlet means on said container means including a spray head for discharging a curable material formed upon mixing of said components;

means defining an internal space within said container means within which said components are mixed to form said mixture upstream of said outlet means, one of said components being present in said container means in a form of globules surrounded by respective destructible layers of a substance which is nonreactive with said components and which layers are in contact with the other of said component;

means for applying pressure to said components to cause said components to flow toward said outlet means;

at least one screen element in said container means encountered by said components as said components pass under pressure through said space to said outlet means for intercepting said globules and effecting rupture of said layers at at least a minimum of said pressure to enable said globules to mix with said other component in said space and form the mixture passing to said outlet means, said screen element having apertures configured to block passage of whole globules surrounded by intact layers of said substance but passing said one of said components from disrupted globules; and conduit means connecting said head with said space and defining a flow path for said material.

5. The system defined in claim 4 wherein at least one of said screen elements is configured to impart a generally sinusoidal flow characteristic to portions of the flow of said curable material.

6. A system for storing, initiating curing of and dispensing a multicomponent curable material having at least two components capable of interreacting upon being mixed together, said system comprising:

container means for storing both of said components;

outlet means on said container means for discharging a curable material formed upon mixing of said components;

means defining an internal space within said container means within which said components are mixed to form said mixture upstream of said outlet means, one of said components being present in said container means entirely in a form of a multiplicity of discrete units of said one of said components surrounded by respective destructible layers of a substance which is nonreactive with said components and which layers are in contact with the other of said components forming a continuous phase in which said units are distributed within said container means;

means for applying pressure to said components to cause said components to flow toward said outlet means; and means in said container means and encountered by said components as said components pass under pressure through said space to said outlet means for destroying said layers to enable said units to mix with said other component in said space and form the mixture passing to said outlet means.

7. The system defined in claim 6 wherein said means in said container means for destroying said layers includes at least one screen provided with apertures dimensioned to block passage of said units with said layers in tact but passing said units upon destruction upon said layers, said layers being destroyed by said screen at at least a minimum value of said pressure as said units are forced through said screen.

8. The system defined in claim 7, further comprising means between said screen element and said outlet means for imparting a generally sinusoidal flow characteristic to portions of the curable material downstream of said screen.

9. The system defined in claim 7 wherein said means for destroying said layers includes at least one pair of rollers for crushing said units.

10. The system defined in claim 7 wherein said outlet means is removably mounted on said container means.

* * * * *